US010996695B2

(12) United States Patent
Chien

(10) Patent No.: US 10,996,695 B2
(45) Date of Patent: May 4, 2021

(54) ELECTRICAL POWER ADAPTER

(71) Applicant: Min-Hung Chien, New Taipei (TW)

(72) Inventor: Min-Hung Chien, New Taipei (TW)

( * ) Notice: Subject to any disclaimer, the term of this patent is extended or adjusted under 35 U.S.C. 154(b) by 0 days.

(21) Appl. No.: 16/797,493

(22) Filed: Feb. 21, 2020

(65) Prior Publication Data

US 2020/0192408 A1 Jun. 18, 2020

Related U.S. Application Data

(63) Continuation-in-part of application No. 16/145,686, filed on Sep. 28, 2018, now Pat. No. 10,601,194.

(51) Int. Cl.

| | |
|---|---|
| ***H01R 25/00*** | (2006.01) |
| ***G05F 1/45*** | (2006.01) |
| ***H01R 13/66*** | (2006.01) |
| ***H01R 31/06*** | (2006.01) |
| *H01R 103/00* | (2006.01) |

(52) U.S. Cl.

CPC ..... *G05F 1/45* (2013.01); *H01R 13/6675* (2013.01); *H01R 31/065* (2013.01); *H01R 2103/00* (2013.01)

(58) Field of Classification Search

CPC .... H01R 31/06; H01R 24/78; H01R 13/6675; H01R 31/02; H01R 13/652; H01R 13/64; H01R 2103/00

USPC ..... 439/638, 171, 518

See application file for complete search history.

(56) References Cited

U.S. PATENT DOCUMENTS

| | | | | |
|---|---|---|---|---|
| 5,616,051 | A * | 4/1997 | Rogers | H01R 27/00 439/518 |
| 5,634,806 | A * | 6/1997 | Hahn | H01R 27/00 439/172 |
| 5,648,712 | A * | 7/1997 | Hahn | H01R 27/00 320/111 |
| 6,227,888 | B1 * | 5/2001 | Hahn | H01R 27/00 439/172 |
| 8,388,352 | B1 * | 3/2013 | ChongYu | H01R 31/06 439/11 |
| 2009/0225486 | A1 * | 9/2009 | Wadsworth | H01R 31/065 361/118 |

(Continued)

*Primary Examiner* — Abdullah A Riyami
*Assistant Examiner* — Nelson R. Burgos-Guntin
(74) *Attorney, Agent, or Firm* — Dunlap Bennett & Ludwig, PLLC

(57) ABSTRACT

A travel power adapter system includes a base unit and a plurality of adapter assemblies. The base unit provides an integral prong configuration associated with an intrinsic electrical plug standard. Each adapter assembly provides a prong configuration associated with a different extrinsic electrical plug standard. The base unit provides a base recess that the integral prong configuration can pivot into in a nested condition. Each adapter assembly provides coupling sleeves dimensioned to slidably receive, in a first direction, the plurality of prongs in the nesting condition, forming an operative association between the base unit and the prong configuration of the adapter assembly, enabling an electrical connection to a receptacle or socket associated with the extrinsic electrical plug standard. The adapter assembly provides a locking unit that engages a locking slot of the base recess, thereby preventing the adapter assembly unintentionally moving in the reverse first direction.

11 Claims, 6 Drawing Sheets

(56) References Cited

U.S. PATENT DOCUMENTS

| | | | | |
|---|---|---|---|---|
| 2009/0291570 | A1* | 11/2009 | Wadsworth | H01R 31/065 439/13 |
| 2010/0190363 | A1* | 7/2010 | Green | H01R 13/6675 439/131 |
| 2014/0145689 | A1* | 5/2014 | Carlucci | H01R 31/065 323/237 |
| 2015/0064955 | A1* | 3/2015 | Liu | H01R 24/68 439/344 |

* cited by examiner

ELECTRICAL POWER ADAPTER

CROSS-REFERENCE TO RELATED APPLICATION

This continuation-in-part non-provisional application claims the benefit of priority of U.S. non-provisional application Ser. No. 16/145,686, filed 28 Sep. 2018, the contents of which are herein incorporated by reference.

BACKGROUND OF THE INVENTION

The present invention relates to electrical power adapters and, more particularly, to a travel power adapter system embodying an adapter base unit provide in an integral prong configuration associated with an intrinsic electrical plug standard with a track and slide configuration for operatively associating the integral prong configuration interchangeably with one of a plurality of adapter assemblies. Each adapter assembly enables interconnection of the integral prong configuration to an electrical receptacle or socket of an extrinsic electrical plug standard different than that of the intrinsic electrical plug standard. Furthermore, there is a locking engagement that can be formed between the adapter assembly and the base unit preventing unintentional disengagement of the adapter assembly and the base unit when removing the adapter assembly from the electrical receptacle or socket.

Portable electric-powered and electronic devices are ubiquitous. Such devices may run on AC current from a receptacle, run on a battery in need of recharging via an AC current from such receptacles, or run on a DC current that can be adapted from an AC current from such receptacles. As a result of their portability, such devices may need to be electrically coupled to various types of receptacles as a user travels from country to country, where each receptacle has a different extrinsic electrical plug standard than the intrinsic electrical plug standard of the integral prong configuration of the device in question.

As can be seen, there is a need for a travel power adapter system enabling an operative association between the intrinsic electrical plug standard of the base unit and the native extrinsic electrical plug standard (e.g., prong configuration, power rating, and frequency) by way of one of a plurality of adapter assemblies that operatively associates the native extrinsic prong configuration with the integral prong configuration of the base unit. The system embodied in the present invention provides a track and slide configuration to enable such operative association condition.

Currently, there are adapter assemblies on the market for portable electric-powered and electronic devices; however, many of these adapter assemblies have a "horizontal oriented" design (i.e., the adapter assembly operatively engages the integral prong configuration of the base unit in the same direction that the extrinsic prong configuration of the adapter assembly engages the electrical receptacle or socket), and as a result of being engaged (slid in and out) in the same direction, the adapter assembly remains inserted when the base unit is pulled out of the native extrinsic electrical receptacle or socket. This is not very convenient.

In order to improve the above problems, a vertical oriented design for the adapter assembly-base unit engagement has been designed. This vertical oriented design enables the integral prong configuration of the adapter base unit to initially be pivoted from a non-nested condition ninety degrees to a nested condition so that when the adapter assembly engages the integral prong configuration in a first direction, the extrinsic electrical plug standard of the adapter assembly engages the electrical receptacle or socket in a second direction orthogonal to the first direction. Thus, when the base unit is pulled out of the electrical receptacle or socket, the adapter assembly does not come off the base unit, stuck in the electrical receptacle or socket.

However, there is still a need for improvement in such designs, because the removal of the base unit from the electrical receptacle or socket (especially if not in a straight line, which may demand a user to stoop down or move themselves into another uncomfortable position) may easily generate a vertical (reverse first direction) component force that the adapter assembly to slide from integral prong configuration, risking disconnection and possibly damage to the integral prong configuration and/or the adapter assembly.

SUMMARY OF THE INVENTION

In one aspect of the present invention, a travel power adapter system, includes the following: a base unit comprising: an intrinsic prong configuration; a base recess recessed in a top surface of the base unit; a locking slot provided in the base recess; and the intrinsic prong configuration pivotal between an outlet position and a nested position within the base recess; one or more adapter assemblies, each adapter assembly comprising: an extrinsic prong configuration; a coupling sleeve providing apertures for slidably receiving the intrinsic prong configuration; the coupling sleeve dimensioned to slidably nest in the base recess while receiving the intrinsic prong configuration, in an operative associated condition, electrically coupling said extrinsic prong configuration to the intrinsic prong configuration; and a locking unit disposed along an upper surface of the coupling sleeve, that locking unit movable between an unlocked engagement and a locked engagement with the locking slot.

In another aspect of the present invention, the travel power adapter system includes the locking unit providing a slider plate with a locking protrusion along a distal end of the slider plate, the locking protrusion dimensioned to form the locked engagement with the locking slot; one or more traction element on an upper surface of the slider plate, wherein the upper surface provides a slider cavity dimensioned for the slider plate to move therein between the unlocked engagement and locked engagement; and a peripheral slot along at least one longitudinal edge of the slider cavity, wherein each peripheral slot is dimensioned so that a longitudinal periphery of the slider plate rides therein when moving between the unlocked engagement and locked engagement.

These and other features, aspects and advantages of the present invention will become better understood with reference to the following drawings, description and claims.

Figure 1:
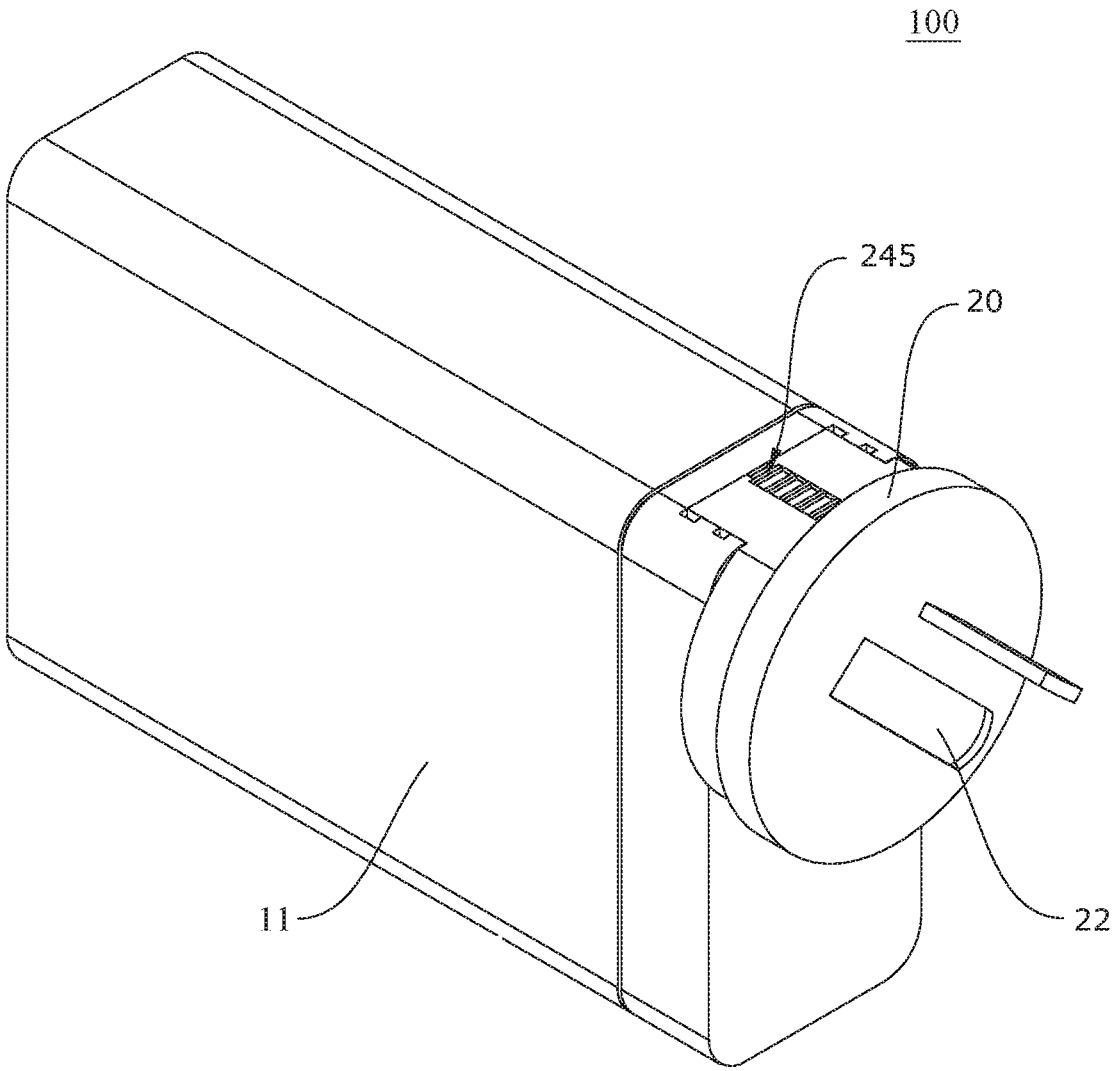
FIG. 1 is a front perspective view of an exemplary embodiment of the present invention.
Figure 2:
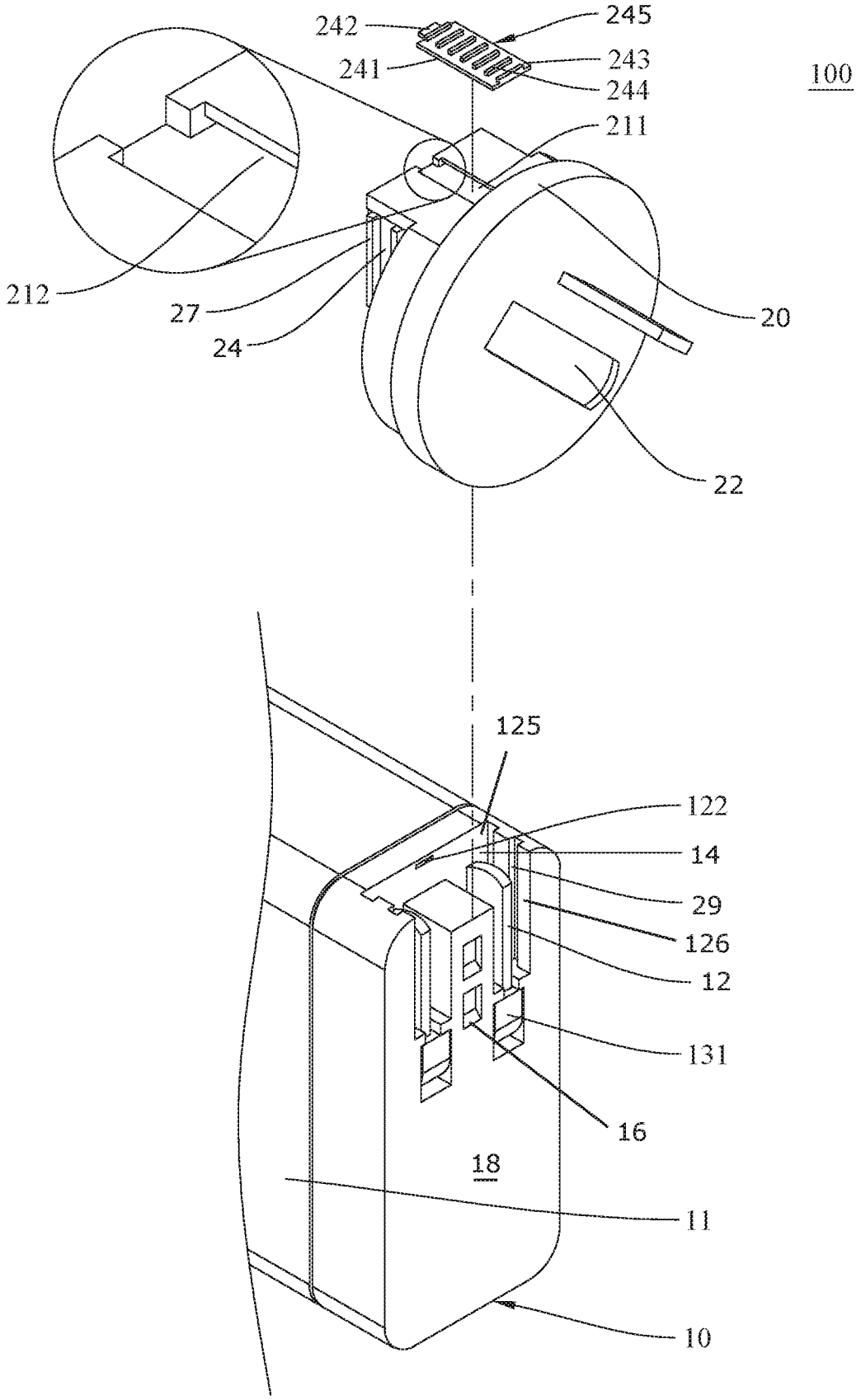
FIG. 2 is an exploded front perspective view of an exemplary embodiment of the present invention, illustrating the integral prong configuration in a nested position, enabling the track and slide configuration functionality for sliding an adapter assembly into an operative association condition, and detailed perspective view of a peripheral slot 212 of a slider cavity 211.
Figure 3:
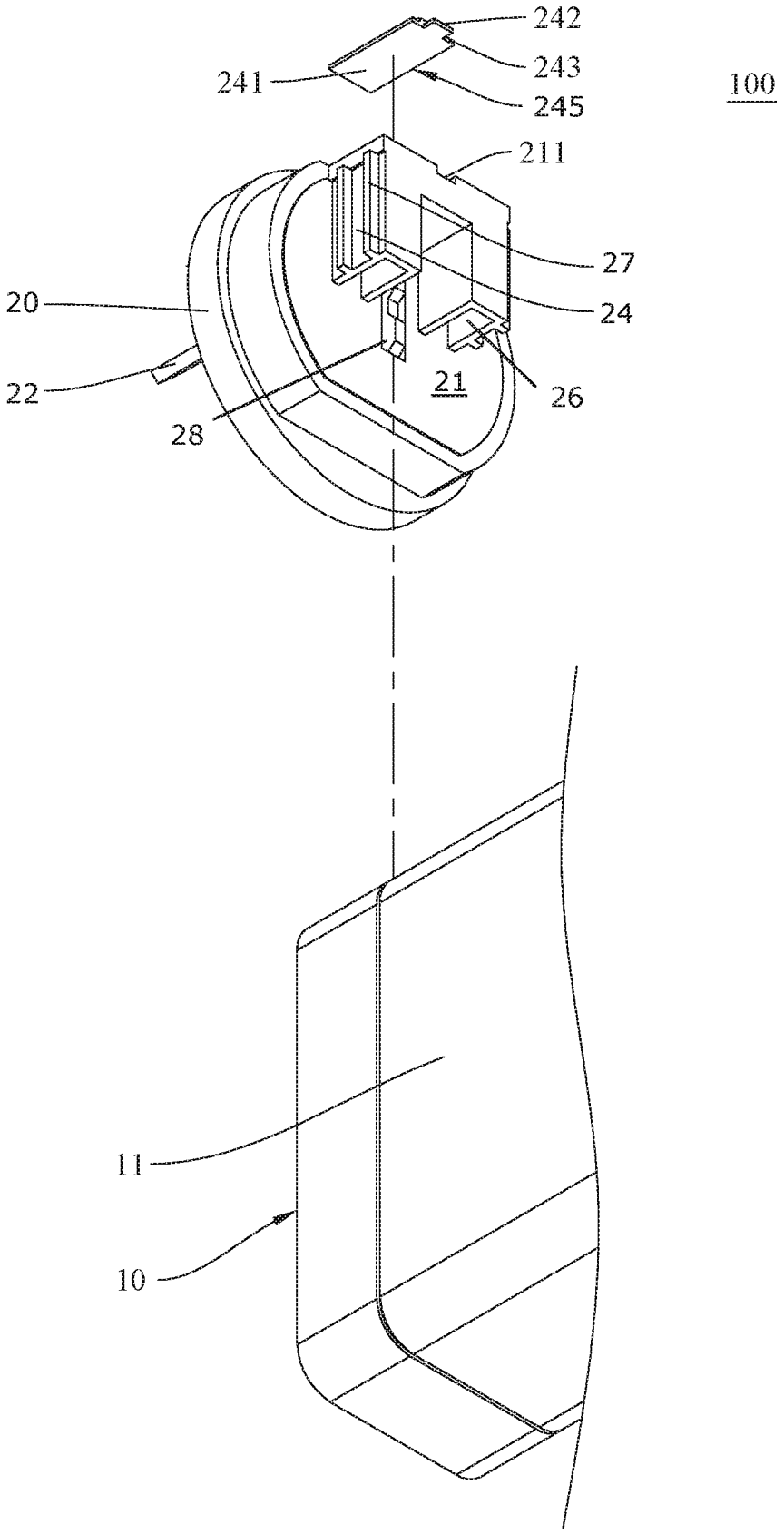
FIG. 3 is an exploded rear perspective view of the adapter assembly of an exemplary embodiment of the present invention.
Figure 4:
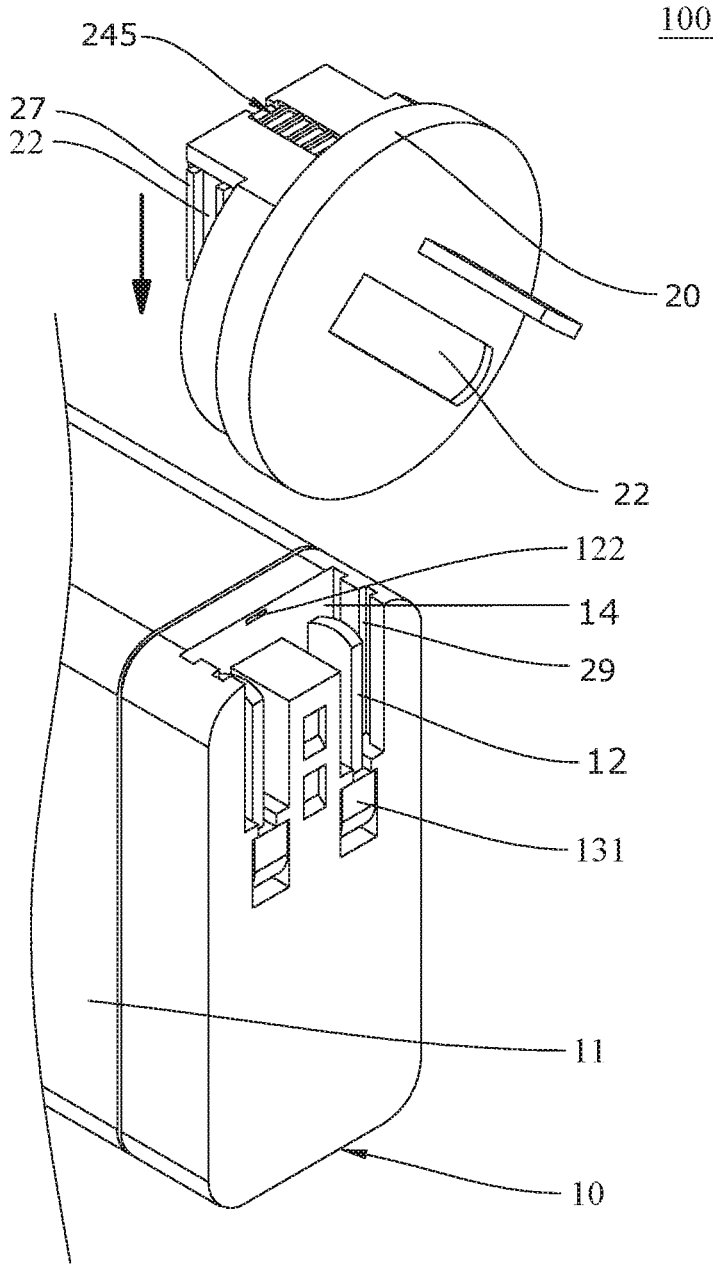
FIG. 4 is a front perspective view of an exemplary embodiment of the present invention, demonstrating moving the adapter assembly a first direction to the operative association condition.
Figure 5:
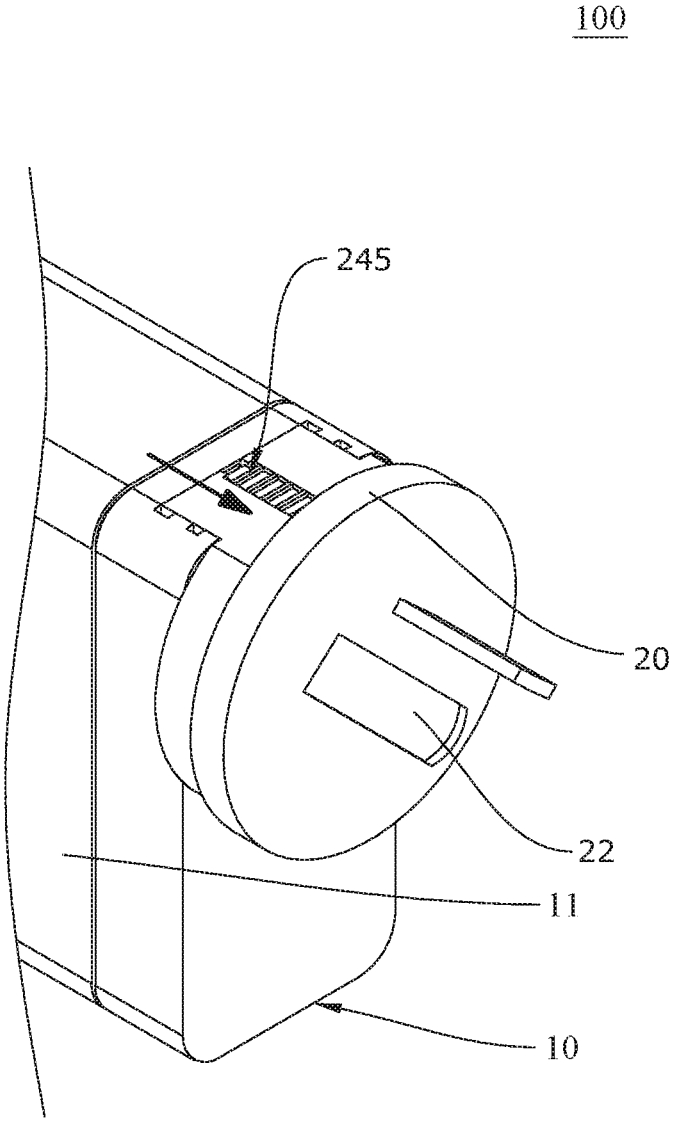
FIG. 5 is a front perspective view of the operative association condition of the adapter assembly and a base unit of an exemplary embodiment of the present invention, demonstrating moving a locking unit in a second direction to an unlocked engagement.

The detailed description and technical content of this creation are described below with reference to the drawings. Furthermore, the drawings in this creation are for convenience of description, and the proportions thereof are not necessarily drawn to the actual scale, and the drawings and their proportions are not intended to limit the scope of the present invention, and are described herein first.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a travel power adapter system. The travel power adapter system includes a base unit and a plurality of adapter assemblies. The base unit provides an integral prong configuration associated with an intrinsic electrical plug standard. Each adapter assembly provides a prong configuration associated with a different extrinsic electrical plug standard. The base unit provides a base recess that the integral prong configuration can pivot into in a nested condition. Each adapter assembly provides coupling sleeves dimensioned to slidably receive, in a first direction, the plurality of prongs in the nesting condition, forming an operative association between the base unit and the prong configuration of the adapter assembly, enabling an electrical connection to a receptacle or socket associated with the extrinsic electrical plug standard. The adapter assembly provides a locking unit that engages a locking slot of the base recess, thereby preventing the adapter assembly unintentionally moving in the reverse first direction.

Referring to FIGS. 1 through 6, the present invention embodies a travel power adapter system 100 providing a base unit 10 of an electrically powered device 11 and a plurality of adapter assemblies 20, wherein each adapter assembly provides an assembly prong configuration 22 associated with an extrinsic electrical plug standard different from the intrinsic electrical plug standard associated with the plurality of integral prongs 12 of the base unit 10. For instance, the base unit 10 may have a plurality of integral prongs 12 arranged in an intrinsic electrical plug standard associated with North America, while the adapter assembly 20 provides a Australian/New Zealand assembly prong configuration 22 (Australian/New Zealand being the extrinsic electrical plug standard). The adapter assembly 20 may provide an American prong configuration 22, a British prong configuration 22, an Italian prong configuration 22, a Swiss prong configuration 22, a South African prong configuration 22, a Russian prong configuration 22, and the like.

The plurality of integral prongs 12 are pivotally connected to the base unit 10, through their pivotably connected shafts 131, so as to move between an outlet (extended or non-nested) position to a nested position within a base recess 14 provided by a top surface 18 of the base unit 10. The base recess 14 has rear wall 125 and two opposing sidewalls 126 parallel to each other and orthogonal to the rear wall 125. The rear wall 125 provides a locking slot 122, just inward of an exterior surface of the base unit 10. In practice, the locking slot 122 can be designed on one of the three side wall faces of the base recess 14 (e.g., along the two opposing sidewalls 126, perhaps) where the structure is permissible. Each sidewall 126 provides recess slots 29.

The adapter assembly 20 provides a mounting base 24. Each mounting base 24 may provide the components shown in FIG. 3; specifically, providing coupling sleeves 26 extending along a bottom surface 21 of the adapter assembly 20. Each distal end of the coupling sleeves 26 provides an aperture dimensioned and adapted to slidably receive each integral prong of the plurality of integral prongs 12 of the base unit, thereby enabling the formation of the operatively associated condition when the plurality of integral prongs 12 are in the nested condition. In other words, the adapter assembly 20 slides between a detached condition and an operative associated condition, wherein there is an electrical connection between the plurality of integral prongs 12 and the assembly prong configuration 22. The base recess 14 may be dimensioned and adapted to snugly receive the coupling sleeves 26. Each coupling sleeve 26 may provide guide protrusions 27 that slide into and mate with recess side slots 29. These features contribute to the track and slide configuration functionality of the present invention.

Figure 6:
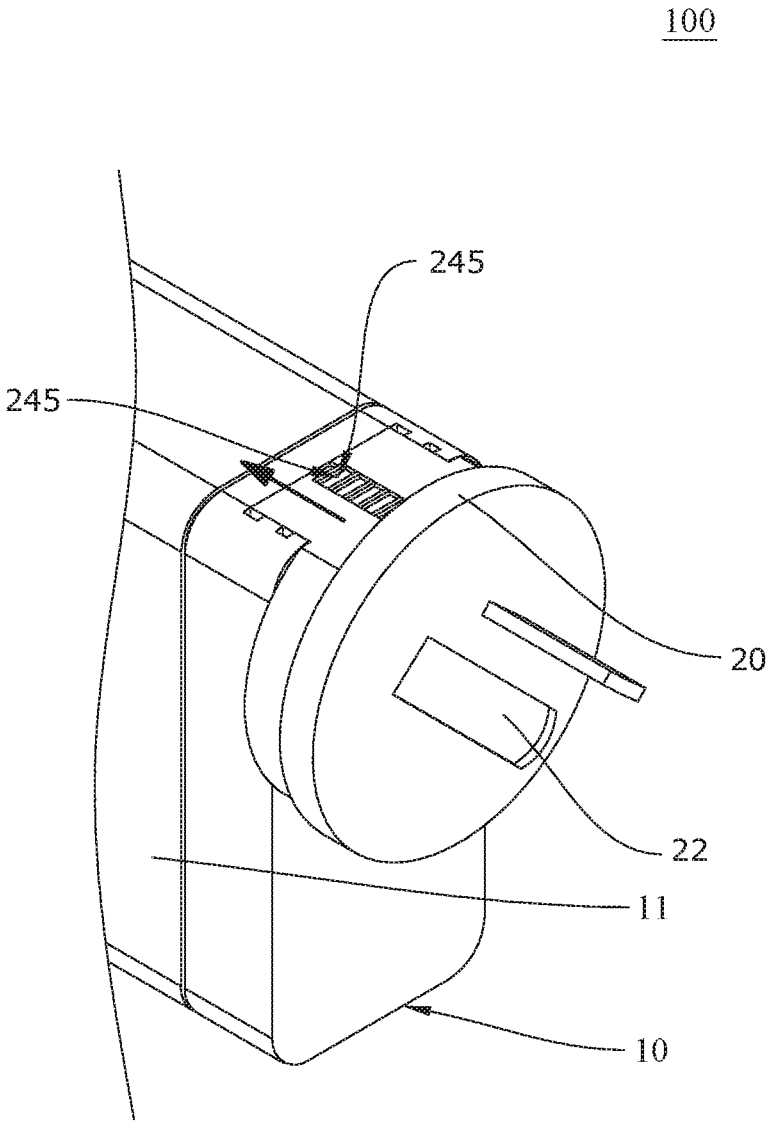
FIG. 6 is a front perspective view of the operative association condition of an exemplary embodiment of the present invention, demonstrating moving the locking unit in a reverse second direction to a locked engagement.

An upper portion of the mounting base 24 may provide a locking unit 245 including a slider plate 241 having a one or more traction elements 244 along a top surface thereof and a locking protrusion 242 extending from a distal portion thereof. In the operative associated condition, the locking protrusion 242 is disposed at a position aligned with and adjacent to the locking slot 122 of the rear wall 125 so that when moving the slider plate 241 to the locked engagement, as illustrated in FIG. 6, the locking protrusion 242 is received in the locking slot 122, restricting the adapter assembly 20 from disengaging from the operatively associated condition.

A slider cavity 211 may recessed into the upper portion of the mounting base 24. The slider cavity 211 provides peripheral slots 212 in which one or both longitudinal peripheries 243 of the slider plate 241 ride, slidably engaging so that the slider plate 241 is secured in the slider cavity 211 yet enabled to slide between a locked engagement and an unlocked engagement, away from in a reverse second direction (FIG. 6) and toward in the second direction (FIG. 5) the assembly prong configuration 22, respectively. In a possible implementation, the locking protrusion 242 can be, but is not limited to, a bump or a hook corresponding to the locking slot 122.

In order to facilitate the user to pull the slider plate 241, the slider plate 241 has the one or more traction elements 244. In a feasible embodiment, the one or more traction elements 244 may be a convex stripe formed on the slider plate 241 or other anti-slip elements, increasing the frictional engagement of the slider plate 241.

In addition to the above-described embodiments, the locking unit 245 can also be other types of locking structures, such as a button, a lever, a knob, etc., or the like, which is not limited in this creation. Therefore, the locking unit 245 of the present invention can effectively prevent the adapter assembly 20 from being unintentionally detached from the plurality of integral prongs 12 in the reverse first direction, thereby increasing the stability and safety of the travel adapter system 100. Furthermore, the adapter assembly 20 can be securely stored in the operative associated condition while traveling, where the travel adapter system 100 may be loosely stored in a pocket of bag.

Likewise, the top surface 18 of the base unit 10 may provide grip slots 16 adjacent to the base recess 14. The bottom surface 21 of the adapter assembly 20 may provide grip nubs 28 to form, in the operatively associated condition, a secured engagement with the grip slots 16. The secured engagement may also provide an audible "click" sound so that the user knows the operatively associated condition has been configured.

The base unit 10 may be an electrical device, a battery, a DC adapter, or the like in need of forming an AC connection. Thus, by interchanging the adapter assemblies so as to conform with the local plug standard, the base unit 10 may be used with any of the different international plug standards during a user's travel across the globe. Of course, the user could move the plurality of integral prongs 20 to the outlet position (non-nested condition) to utilize its intrinsic electrical plug standard directly into a matching electrical receptacle or outlet.

A method of using the present invention may include the following. The travel adapter system 100 disclosed above may be provided. A user finding themselves in need of an electrical connection having an extrinsic electrical plug standard that differs from the intrinsic electrical plug standard of the base unit 10, need only slide the adapter assembly 20 into the operative associated condition, over the nested plurality of integral prongs 12 in the first direction, providing the prong configuration 22 that matches the relevant electrical plug standard. This track and slide configuration functionality is further enabled by the engagement of guide protrusions 27 that slide into the recess slots 29, preventing movement of the adapter assembly 20 in a second direction. The track and slide configuration functionality embodied in the present invention provides an easy, safe, fool-proof installation step.

Then the user may slide the slider plate 241 through manually engaging the one or more traction elements 244 until the locking protrusion 242 mates with the locking slot 122, in the locked engagement, restraining the adapter assembly 20 from moving in the reverse first direction out of the operative associated condition. This restraint prevents any unintentional detachment of the adapter assembly 20 from the base unit 10 when removing the base unit 10 from the extrinsic electrical receptacle or socket.

When the user wants to move to the unlocked engagement, they manually slide the slider plate 241 toward the adapter assembly 20 in the second direction, enabling the user to intentionally detach the adapter assembly 20 from the base unit 20 in the first direction.

It should be understood, of course, that the foregoing relates to exemplary embodiments of the invention and that modifications may be made without departing from the spirit and scope of the invention as set forth in the following claims.

What is claimed is:

1. A travel power adapter system, comprising:

a base unit comprising:

an intrinsic prong configuration;

a base recess recessed in a top surface of the base unit;

a locking slot provided in the base recess, wherein the locking slot has a stop in a first direction; and the intrinsic prong configuration pivotal between an outlet position oriented in a second direction and a nested position oriented in the first direction within the base recess;

one or more adapter assemblies, each adapter assembly comprising:

an extrinsic prong configuration;

a coupling sleeve providing apertures for slidably receiving the intrinsic prong configuration;

the coupling sleeve dimensioned to slidably nest in the base recess while receiving the intrinsic prong configuration, in an operative associated condition, electrically coupling said extrinsic prong configuration to the intrinsic prong configuration; and a locking unit disposed along an upper surface of the coupling sleeve, that locking unit movable along the second direction between an unlocked engagement and a locked engagement with the locking slot.

2. The system of claim 1, wherein the locking unit provides a slider plate with a locking protrusion along a distal end of the slider plate, the locking protrusion dimensioned to form the locked engagement with the locking slot.

3. The system of claim 2, further comprising one or more traction element on an upper surface of the slider plate.

4. The system of claim 3, wherein the upper surface provides a slider cavity dimensioned for the slider plate to move therein between the unlocked engagement and locked engagement.

5. The system of claim 4, further comprising a peripheral slot along at least one longitudinal edge of the slider cavity, wherein each peripheral slot is dimensioned so that a longitudinal periphery of the slider plate rides therein when moving between the unlocked engagement and locked engagement.

6. The system of claim 1, wherein the extrinsic prong configuration is an Australian/New Zealand prong configuration.

7. The system of claim 1, wherein the extrinsic prong configuration is a UK prong configuration.

8. The system of claim 1, wherein the extrinsic prong configuration is an EU prong configuration.

9. The system of claim 1, wherein the extrinsic prong configuration is a South African prong configuration.

10. The system of claim 1, wherein the extrinsic prong configuration is a Brazilian prong configuration.

11. The system of claim 1, wherein the extrinsic prong configuration is an Indian prong configuration.

* * * * *